US006484896B2

(12) United States Patent
Ma

(10) Patent No.: US 6,484,896 B2
(45) Date of Patent: Nov. 26, 2002

(54) TAMPER EVIDENCING CLOSURE

(75) Inventor: Mike Xiaoli Ma, San Jose, CA (US)

(73) Assignee: Portola Packaging, Inc., San Jose, CA (US)

( * ) Notice: Subject to any disclaimer, the term of this patent is extended or adjusted under 35 U.S.C. 154(b) by 0 days.

(21) Appl. No.: 09/900,505

(22) Filed: Jul. 5, 2001

(65) Prior Publication Data

US 2002/0033374 A1 Mar. 21, 2002

Related U.S. Application Data

(63) Continuation-in-part of application No. 09/653,679, filed on Sep. 1, 2000, now abandoned, which is a continuation of application No. 09/323,571, filed on Jun. 1, 1999, now Pat. No. 6,112,923, which is a continuation-in-part of application No. 08/904,878, filed on Aug. 1, 1997, now Pat. No. 5,913,437.

(51) Int. Cl.[7] ..... B65D 39/00
(52) U.S. Cl. ..... 215/252; 215/43
(58) Field of Search ..... 215/252, 43

(56) References Cited

U.S. PATENT DOCUMENTS

| | | | | |
|---|---|---|---|---|
| 4,511,053 | A | | 4/1985 | Brandes et al. |
| 4,664,278 | A | | 5/1987 | Barriac |
| 4,732,289 | A | | 3/1988 | Granat et al. |
| 4,801,031 | A | | 1/1989 | Barriac |
| 4,813,561 | A | | 3/1989 | Ochs |
| 4,875,594 | A | | 10/1989 | Ochs |
| 4,978,016 | A | | 12/1990 | Hayes |
| 4,981,230 | A | | 1/1991 | Marshall et al. |
| 5,076,453 | A | | 12/1991 | Odet |
| 5,105,960 | A | | 4/1992 | Crisci et al. |
| 5,190,178 | A | | 3/1993 | Luch |
| 5,285,912 | A | | 2/1994 | Molinaro |
| 5,307,945 | A | | 5/1994 | Hidding et al. |
| 5,307,946 | A | | 5/1994 | Molinaro |
| 5,346,082 | A | | 9/1994 | Ochs et al. |
| 5,400,913 | A | | 3/1995 | Kelly |
| 5,415,306 | A | | 5/1995 | Luch et al. |
| 5,456,376 | A | | 10/1995 | Luch et al. |
| 5,465,876 | A | | 11/1995 | Crisci |
| 5,480,045 | A | | 1/1996 | Molinaro et al. |
| 5,533,633 | A | | 7/1996 | King |
| 5,570,798 | A | | 11/1996 | Hayashida et al. |
| 5,609,262 | A | | 3/1997 | Trout |
| 5,660,288 | A | | 8/1997 | Nyman, Jr. |
| 5,727,705 | A | | 3/1998 | Kelly |
| 5,749,484 | A | | 5/1998 | Trout |
| 6,015,054 | A | * | 1/2000 | King et al. ..... 215/252 |
| 6,116,442 | A | | 9/2000 | Higgins |
| 6,276,543 | B1 | * | 8/2001 | German et al. ..... 215/252 |

FOREIGN PATENT DOCUMENTS

| | | |
|---|---|---|
| DE | 39 12 137 A1 | 10/1990 |
| WO | WO 00/12402 A1 | 3/2000 |

* cited by examiner

*Primary Examiner*—Stephen K. Cronin
(74) *Attorney, Agent, or Firm*—Dorsey & Whitney LLP

(57) ABSTRACT

A container including a neck and an opening, in combination with a tamper-evidencing closure including a top, a depending annular skirt and a tamper-evidencing band frangibly connected to the annular skirt. The container includes a first securing structure on the neck spaced from the opening. The tamper-evidencing band includes an inwardly turned retaining rim that extends at least partially upwardly. The retaining rim has a free edge for engagement with the locking surface as the closure is removed from the neck. The retaining rim includes a plurality of outwardly directed flutes spaced circumferentially thereon and a second securing structure located on the retaining rim between the flutes.

16 Claims, 14 Drawing Sheets

TAMPER EVIDENCING CLOSURE

RELATED APPLICATIONS

This application is a Continuation-in-Part of U.S. patent application Ser. No. 09/653,679 filed Sep. 1, 2000, abandoned, which is a Continuation of U.S. patent application Ser. No. 09/323,571, filed Jun. 1, 1999 and now U.S. Pat. No. 6,112,923, which is a Continuation-in-Part of U.S. patent application Ser. No. 08/904,878, filed Aug. 1, 1997 and now U.S. Pat. No. 5,913,437, the entire contents of which are incorporated herein by this reference.

BACKGROUND OF THE INVENTION

1. Field of the Invention

The present invention relates to improvements tamper-evidencing closures including tamper-evidencing bands such as those commonly used as bottle caps. In particular, the present invention relates to an improved detachable tamper-evidencing band design for improved mounting of the closure on a spout or neck of a container, as well as to improve the engagement of the tamper-evidencing band with the spout or neck.

2. Description of Related Art

U.S. Pat. No. 4,801,031 to Barriac discloses a tamper-indicating closure that includes an inwardly folded tamper-indicating band with intermittent pleats, around the inwardly folded portion of the band. The pleats are inwardly directed and spaced around the circumference of the band. U.S. Pat. No. 5,400,913 to Kelly discloses a similar tamper-indicating closure that also has an inwardly folded tamper-indicating band with continuous pleats around the inwardly folded portion of the band.

As discussed in the Kelly '913 patent, the tamper-indicating band should slip over the locking bead or rim of the container neck without damaging the frangible web connecting the band to the skirt of the closure. The tamper-indicating band must be sufficiently elastic in order to avoid too great a resistance when closing the bottle, which could damage the frangible web. However, the tamper-indicating band should be sufficiently stiff in order to reliably engage the locking bead of the container neck and thereby hold the band beneath the locking bead when opening the closure, so that the tamper-indicating band will tear at the frangible web.

The Kelly '913 patent improves the flexibility of the inwardly folded pleated portion of the band in two ways. One, a frangible web is provided between each pleat. The frangible webs between the pleats ensure high elasticity of the tamper-indicating band during closure. Alternatively, individual bridges, instead of a frangible web, are provided between the pleats. The bridges are relatively easily damaged during opening of the closure, thus improving the tamper-indicating nature of the closure.

It has been determined by the applicant herein that the inwardly-turned pleated designs of both the Barriac '031 patent and the Kelly '913 patent have a tendency to improperly grip the locking bead of the container neck and, thereby allow the tamper-indicating band to slip back upwardly over the locking bead upon opening of the closure, which defeats the tamper-indicating aspect of the designs. The present invention improves upon this aspect of prior art pleated tamper-indicating bands.

It is also known for the internal thread pattern of a bottle cap to include spaced gaps around the spiral thread bead for the purpose of reducing weight of the bottle cap as well as to simplify tooling production required to manufacture the bottle caps. The present invention also provides an improved spiral thread pattern and design.

SUMMARY OF THE INVENTION

Briefly described, the present invention comprises a tamper-evidencing closure for a container with a locking surface on the neck of the container, with the closure including a closure or cap with a top portion and a depending annular skirt, a tamper-evidencing band connected to the lower edge of the annular skirt by means of a frangible connection, the tamper-evidencing band including an inwardly turned retaining rim that extends at least partially upwardly relative to the container neck, the retaining rim including a free edge that is adapted to engage the locking surface of the container neck, the free edge of the retaining rim including ramp elements that provide for one-way screwing of the closure cap onto a neck having corresponding ramp elements.

One aspect of the present invention is directed to a container including a neck and an opening, in combination with a tamper-evidencing closure including a top, a depending annular skirt and a tamper-evidencing band frangibly connected to the annular skirt. The container includes a first securing structure on the neck spaced from the opening. The tamper-evidencing band includes an inwardly turned retaining rim that extends at least partially upwardly. The retaining rim has a free edge for engagement with the locking surface as the closure is removed from the neck. The retaining rim includes a plurality of outwardly directed flutes spaced circumferentially thereon and, optionally, a second securing structure located on the retaining rim between the flutes.

The accompanying drawings, which are incorporated in and form a part of this specification, illustrate embodiments of the invention and, together with the description, serve to explain the principles of the invention.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
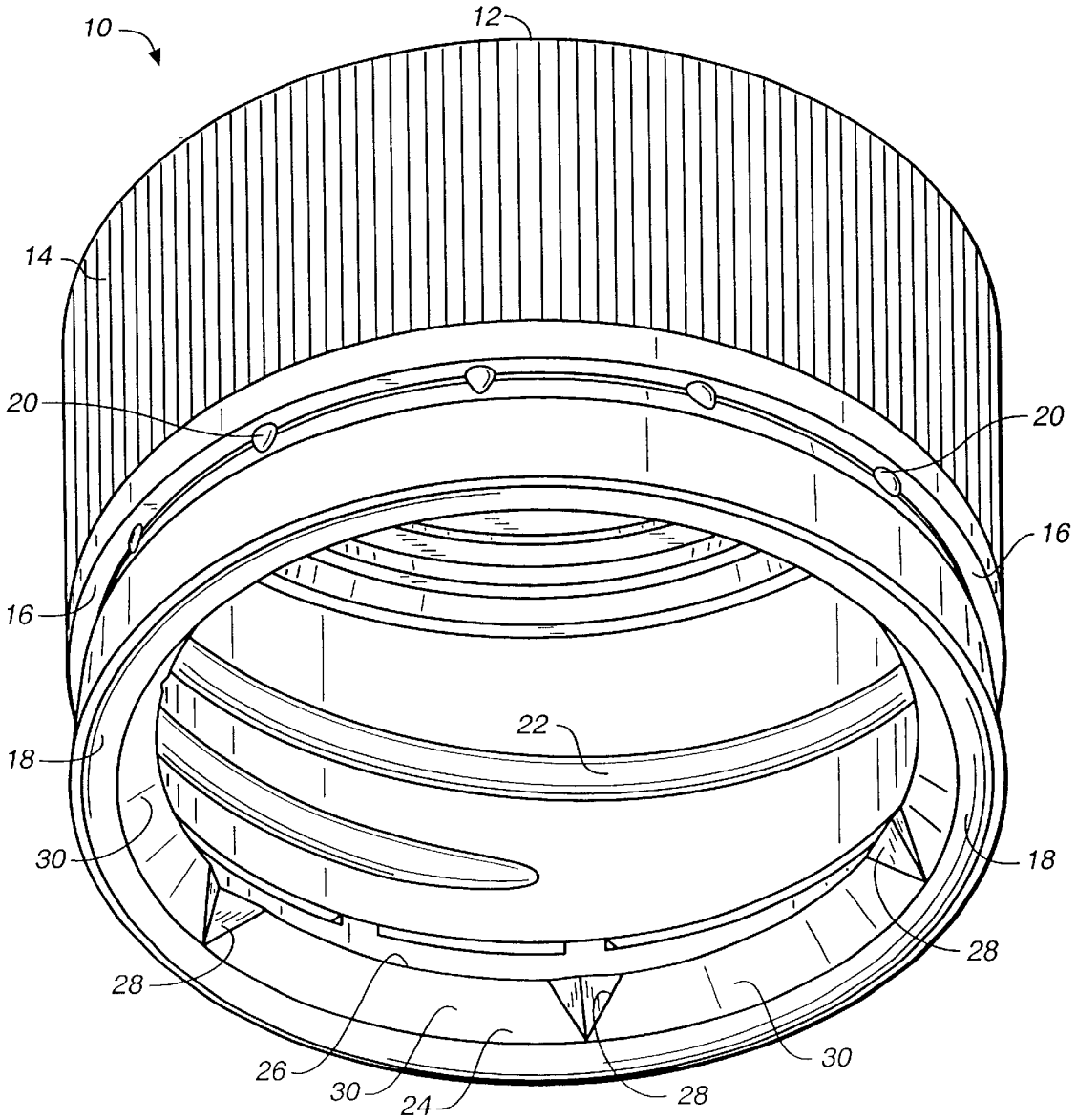
FIG. 1 is a perspective view of the tamper-evidencing closure of the present invention.

Referring to FIG. 1, a tamper evidencing closure in the form of a bottle cap 10 forms a closure for capping off a spout or container neck of a bottle (not shown). Bottle cap 10 includes a round top portion 12 and a depending annular or cylindrical skirt 14. Skirt 14 includes a lower edge 16, to which a tamper-evidencing band 18 connects by means of a frangible connection in the form of thin-walled, breakable connections 20. The internal side wall of skirt 14 includes a conventional spiral thread bead 22. The novelty of the embodiment of the present invention shown in FIG. 1 is believed to reside in the design of tamper-evidencing band 18 and, accordingly, the design of top portion 12 and depending annular skirt 14 by themselves form no part of the present invention.

Tamper-evidencing band 18 includes an inwardly and upwardly turned, annular retaining rim 24. Retaining rim 24 includes an upper free edge 26. Free edge 26 includes pleats 28, which are pleated radially outwardly, and arcuate portions 30 therebetween.

Figure 2:
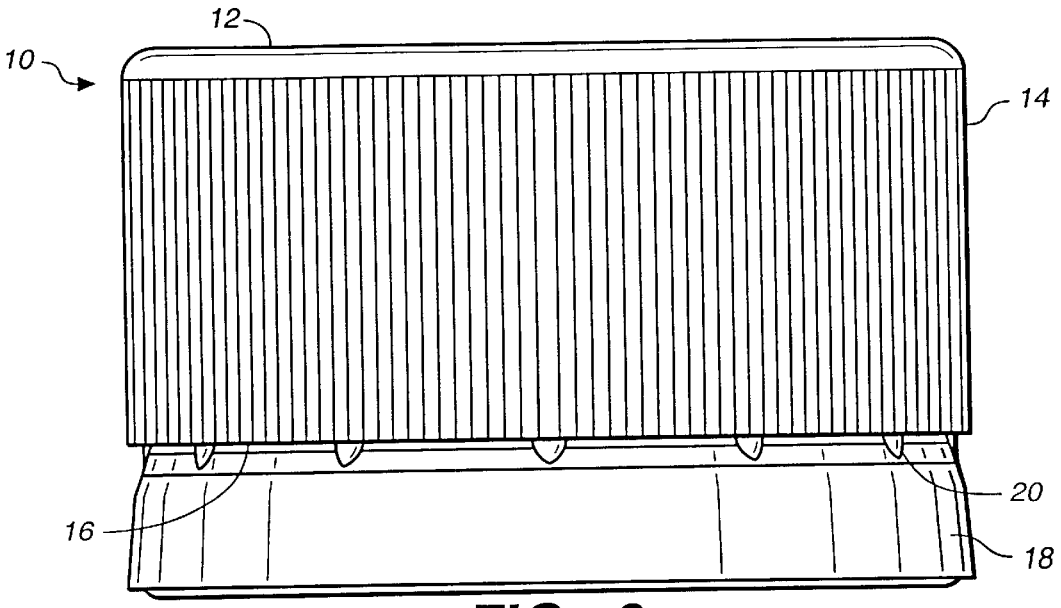
FIG. 2 is a side elevational view of the tamper-evidencing closure of FIG. 1.
Figure 3:
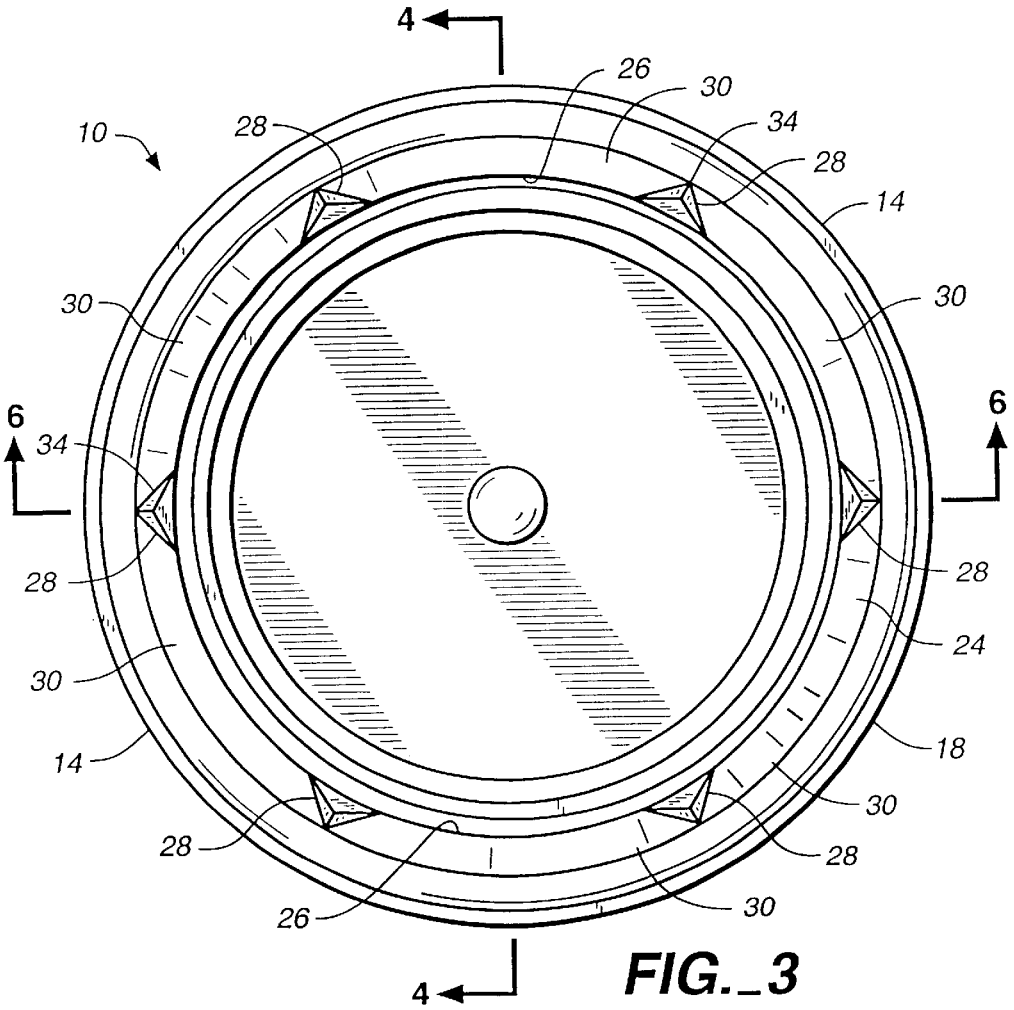
FIG. 3 is a bottom plan view of the tamper-evidencing closure of FIG. 2.
Figure 4:
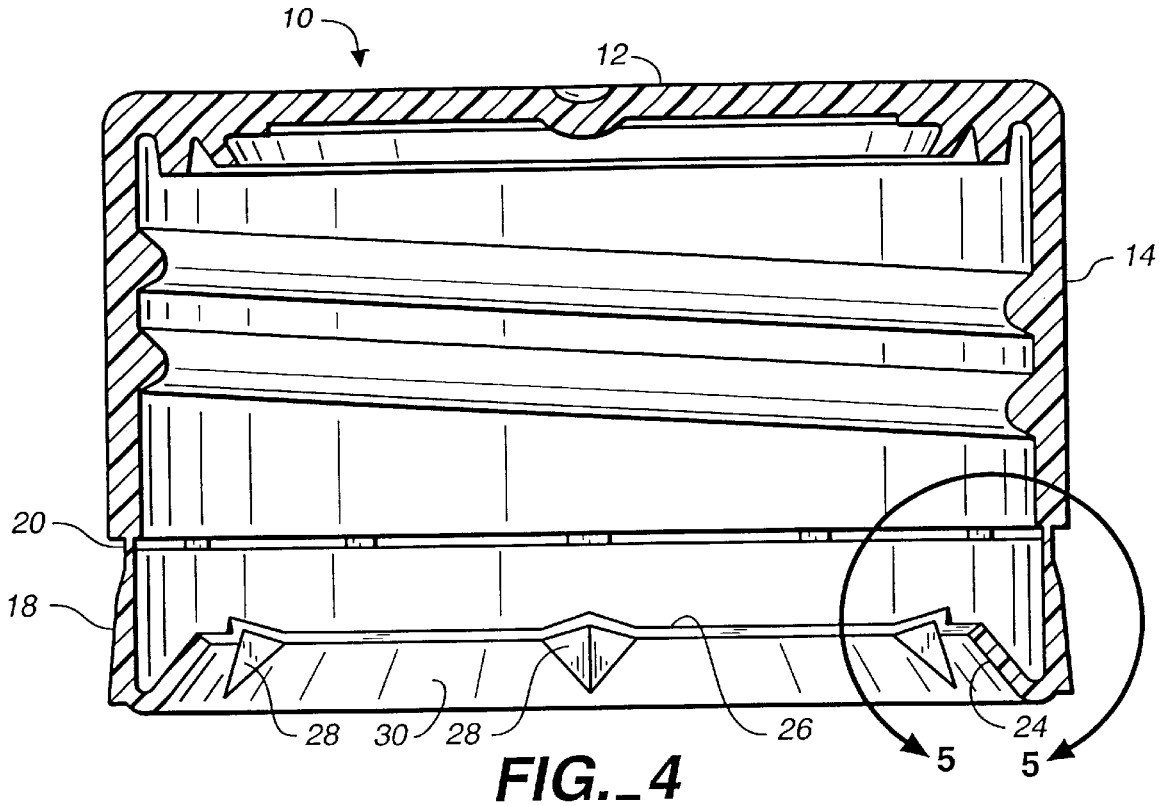
FIG. 4 is a sectional view, taken along the line 4—4 of FIG. 3.
Figure 5:
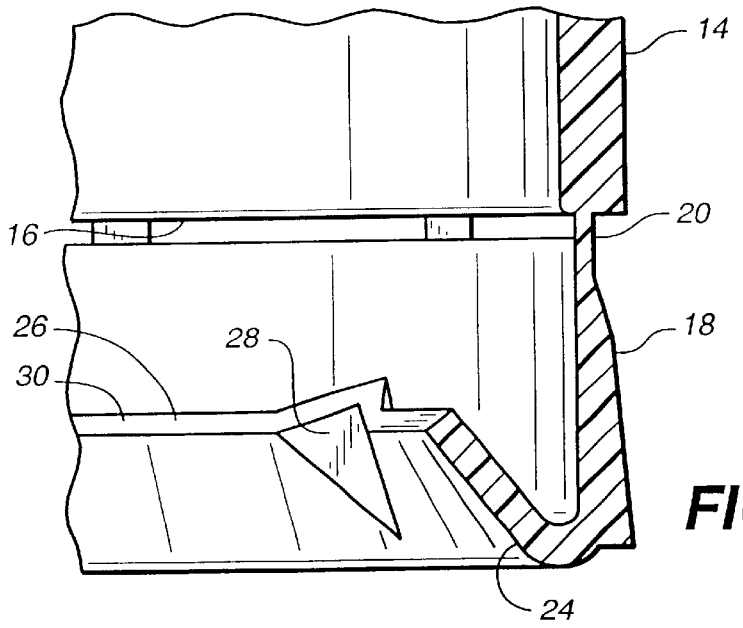
FIG. 5 is an enlarged, detail view of the retaining rim of the tamper-evidencing closure of FIG. 4.
Figure 6:
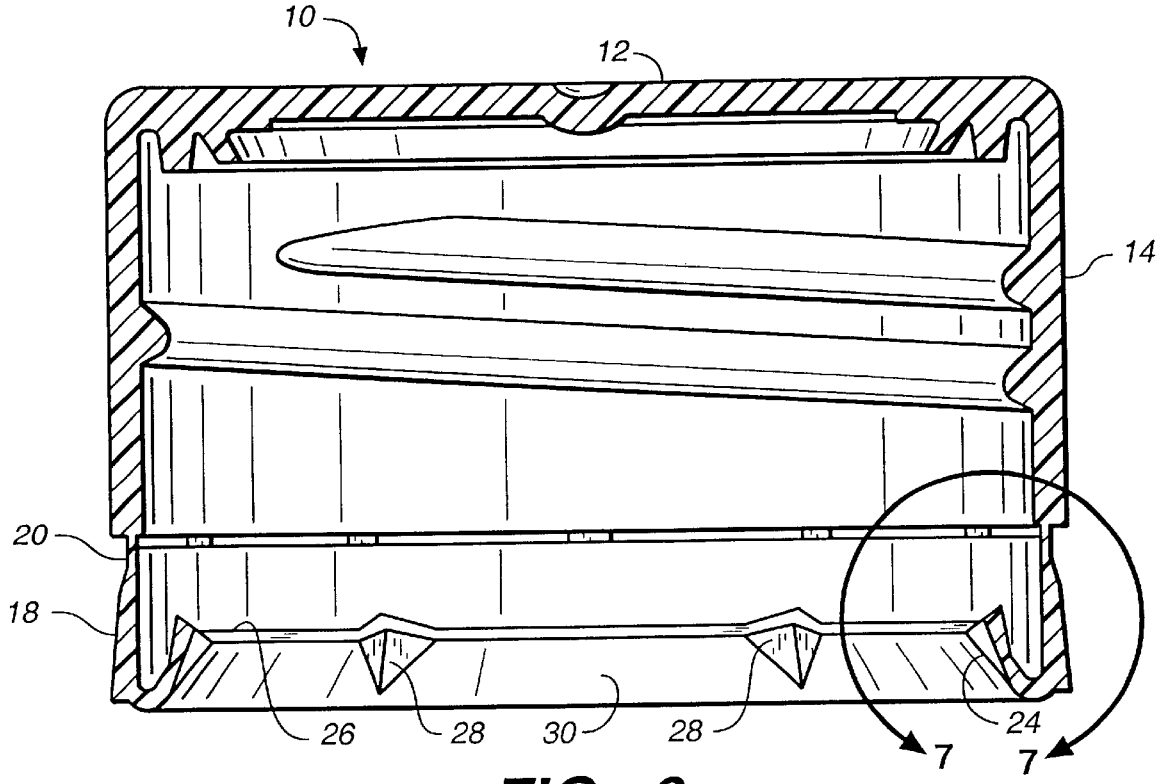
FIG. 6 is a sectional view, taken along the line 6—6 of FIG. 3.
Figure 7:
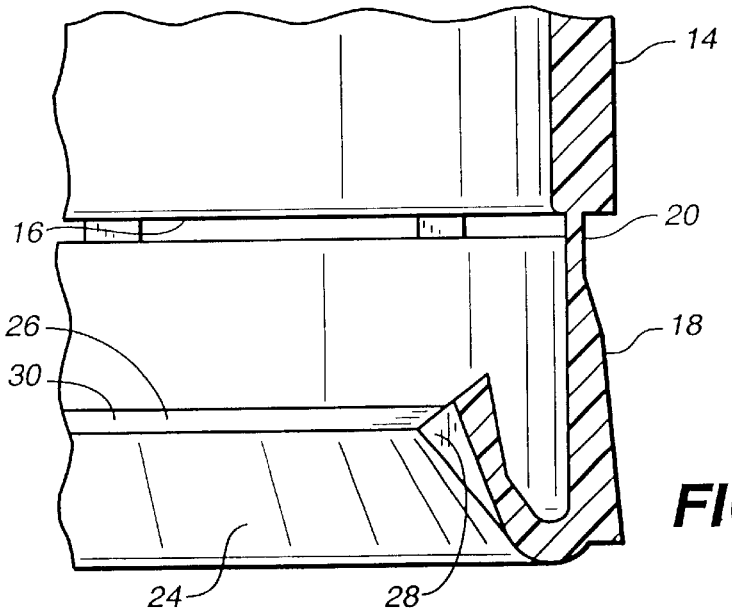
FIG. 7 is an enlarged, detail view of the retaining rim of the tamper-evidencing closure of FIG. 6.

Referring to FIGS. 2 and 3, bottle cap 10 includes a series of frangible connections 20 that are formed by thin wall segments which have sufficient compressive rigidity to withstand the compressive forces imposed by tamper-evidencing band 24 as the bottle cap is mounted onto a container spout, yet also has minimal tensile strength so that frangible connections 20 break when the bottle cap is threaded back off of the container spout.

A series of six flutes 28 are formed in the upwardly and inwardly turned retaining rim 24. While the present invention is not meant to be limited to a particular number of flutes, it is desirable to provide at least two flutes and preferably at least four. In the embodiment shown, the flutes are formed as pleats, six in number. However, other flute designs can be used so long as the design allows the upper edge of the rim to expand. Provision of six pleats, of course, creates six arcuate portions 30 along free edge 26. Arcuate portions 30 have a radius of curvature that approximates the curvature of the container spout so that when the bottle cap is mounted onto the container neck, upper edge 26 of the arcuate portions firmly grips a locking surface on the container neck.

Pleats 28 are pleated radially outwardly of arcuate portions 28. In other words, pleats 28 fold outwardly of arcuate portions 30 toward depending annular skirt 14. Pleats 28 include a vertex 34 that is spaced a short distance inwardly of skirt 14. Preferably, the depth of pleats 28 is sufficient that outer extremity 34, i.e. the vertex, of each pleat remains underneath the locking surface of the container neck. This is discussed in more detail with reference to FIG. 11.

Referring to FIGS. 4–7, inwardly turned retaining rim 24 extends at least partially upwardly so that its upper free edge 26 faces upwardly and is positioned to engage the locking surface of the container neck. It can also be seen in these figures that pleats 28 extend radially outwardly from arcuate portions 30. It is known to provide inwardly projecting pleats, such as those found on the bottle caps disclosed in the prior mentioned Kelly '913 patent and the Barriac '031 patent. Inwardly projecting pleats result in less upper free edge contact with the locking surface of the container neck, which can result in the retaining rim slipping over the locking surface without the frangible connections breaking when the bottle cap is initially unscrewed off of the container neck.

The thin wall construction of frangible connections 20 allows for relatively easy breakage of the frangible material when free edge 26 of retaining rim 24 engages the locking surface of the container neck. Yet, frangible connections 20 have sufficient compressive strength to withstand the initial compressive forces of tamper-evidencing band 18 when the bottle cap is first threaded onto the container neck.

Figure 8:
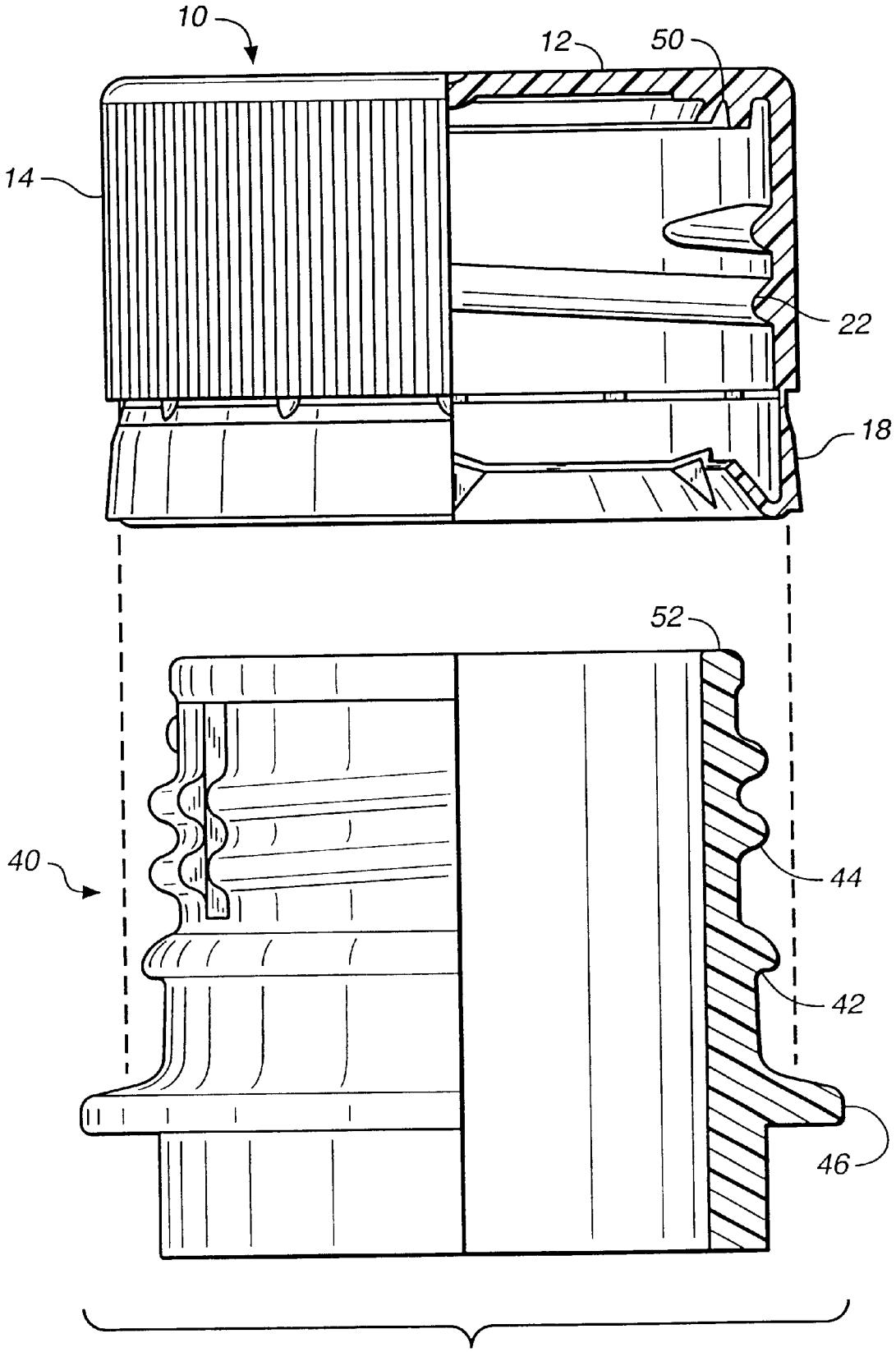
FIG. 8 is an exploded view of the bottle cap of FIG. 1 and a container neck, with the tamper-evidencing closure and container neck shown in quarter section.
Figure 9:
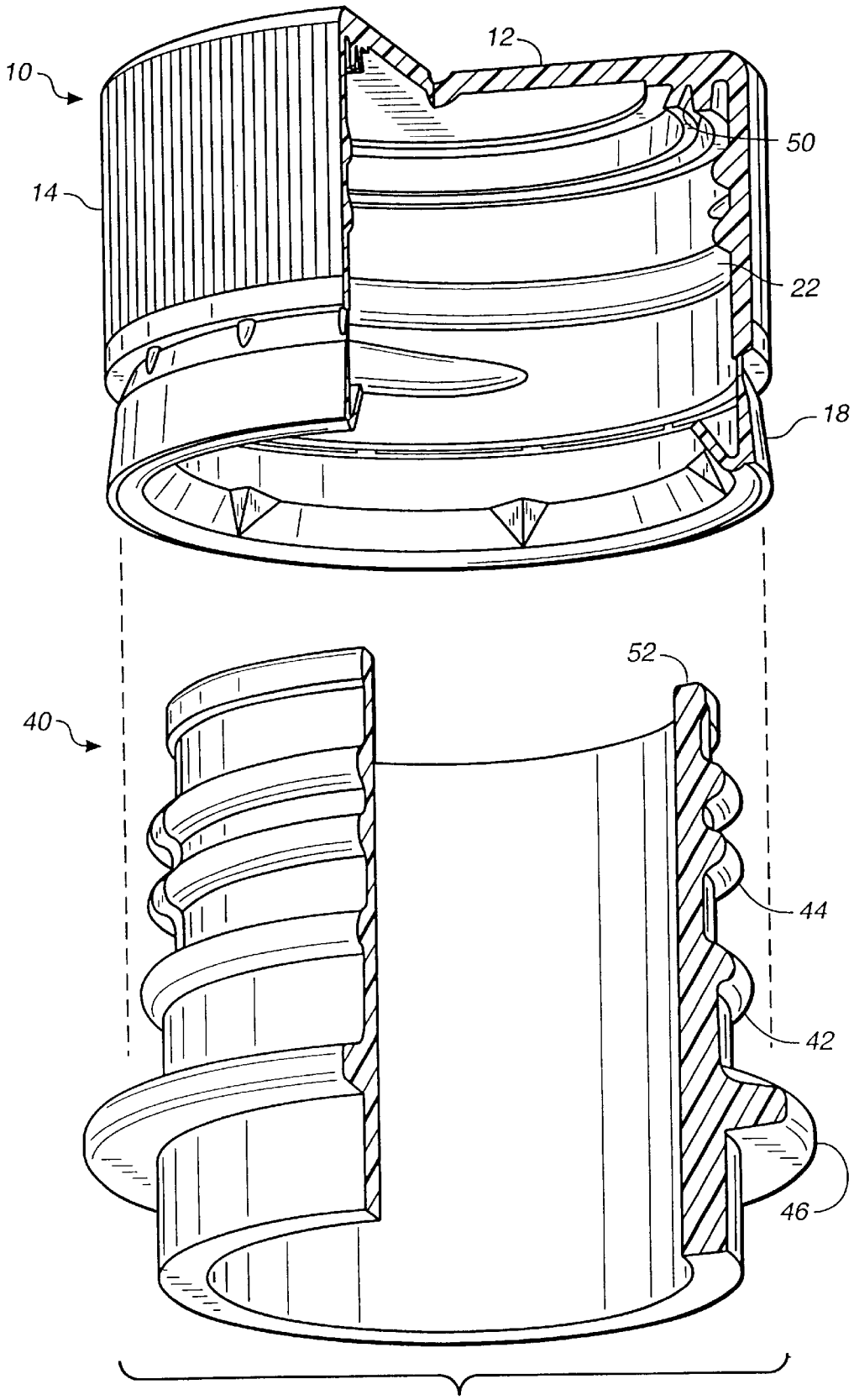
FIG. 9 is an exploded perspective view of the tamper-evidencing closure and container neck of FIG. 8.

FIGS. 8 and 9 illustrate a design for a conventional bottle neck 40. The design of bottle neck 40 forms no part of the present invention aside from the fact that bottle neck 40 requires some type of locking surface 42, such as an annular bead, rim or the like. The rest of the features of bottle neck 40 are conventional in design, including thread 44 and annular base flange 46. The retaining rim of the bottle cap locks underneath locking surface 42.

Also shown in FIGS. 8 and 9 is an internal annular groove 50, which mates with upper rim 52 of bottle neck 40. This creates a leak-proof seal around the opening of bottle neck 40.

Figure 10:
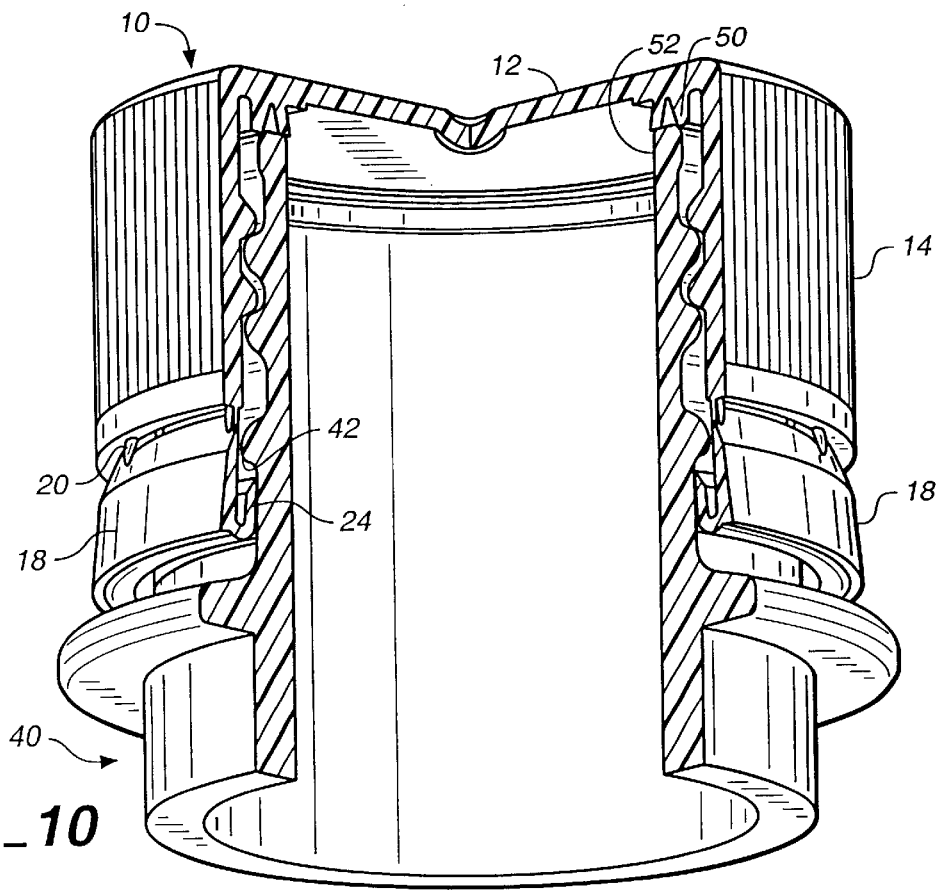
FIG. 10 is a quarter section perspective view of the tamper-evidencing closure mounted onto the container neck.
Figure 11:
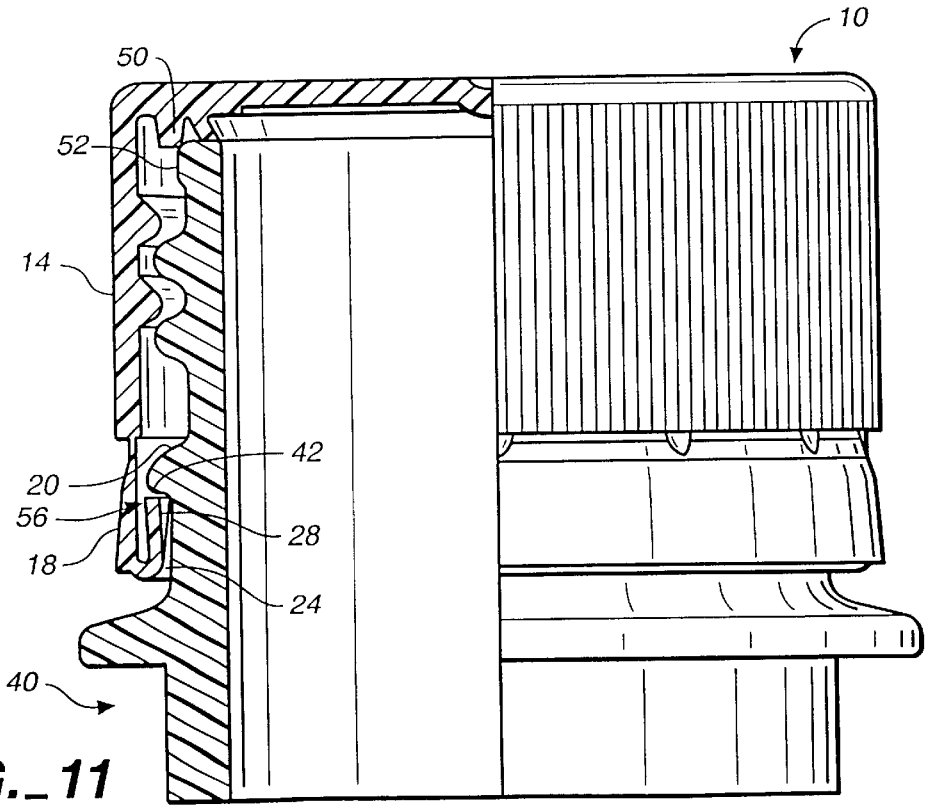
FIG. 11 is a side elevational view, shown in partial section, of the tamper-evidencing closure mounted onto the container neck.

FIGS. 10 and 11 show bottle cap 10 threadably mounted onto bottle neck 40. Retaining rim 24 is bent and flexed outwardly to expand its diameter to match the diameter of bottle neck 40. The upper edge of retaining rim 24, including the upper edge of pleats 28, engage locking surface 42. It can be seen in FIG. 11 that there is a small gap 56 between pleat 28 and the inside wall of tamper-evidencing band 18.

When bottle cap 10 is unscrewed off of bottle neck 40, retaining rim 24 engages locking surface 42. Due to the position of frangible connections 20 on the outside of locking surface 42, a slight torque is placed on the retaining rim, which may tend to cause retaining rim 24 to move outwardly toward tamper-evidencing band 18. If this happens, pleats 28 engage band 18 and prevent the upper free edge of the retaining rim from moving outwardly from underneath the locking surface, which would allow the tamper-evidencing band to slip over the locking surface without breaking the frangible connections.

Another advantage of the design of the tamper-evidencing band of the present invention is that it is more difficult to "tamper" with the band. Theoretically, it is possible to pry the tamper-evidencing band out beyond the locking surface, with the use of a flat edge tool such as a standard screw driver. With prior art designs, only the inwardly directed pleats needed to be pried out over the locking surface. With the present design, because the retaining rim includes arcuate portions that engage the locking surface across at least a majority of the upper free edge surface of the retaining rim, it is more difficult to pry outwardly enough of the retaining rim to slip the tamper-evidencing band out over the locking surface.

Figure 12:
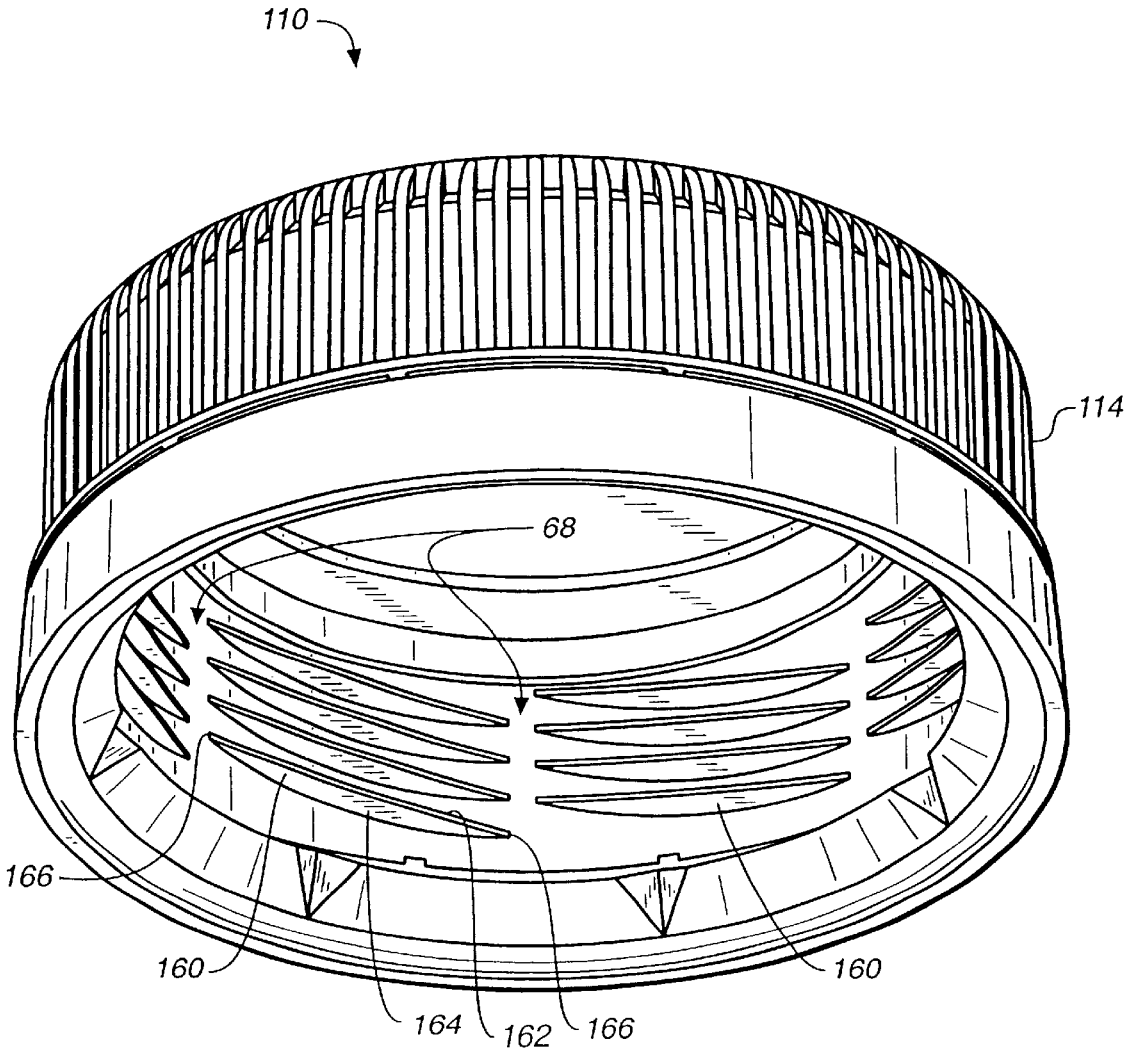
FIG. 12 is a perspective view of another embodiment of the internal thread pattern of the tamper-evidencing closure of FIG. 1.

FIG. 12 illustrates the design for an alternative embodiment for the internal thread pattern of bottle cap 110. It can be seen that the thread pattern is formed by a series of thread segments 160. Each thread segment 160 is shaped like a chord segment with a straight inner edge 162 that creates a wider depth at its center 164 and progressively becomes shallower out to its ends 166, where it becomes flush with the inner surface of skirt 114.

Thread segments 160 are vertically aligned with the segments above and below in a manner that creates gaps 168. In addition, thread segments 160 are aligned along a spiral path with the segments at either side, so as to create an intermittently defined thread channel for the thread of a container neck.

An advantage of the thread design shown in FIG. 12 is not only that it creates a much more light weight bottle cap, it is also much easier to manufacture from a tooling standpoint. Molds for injection molding bottle caps like those discussed herein can more easily be fabricated for producing thread segments as shown.

Figure 13:
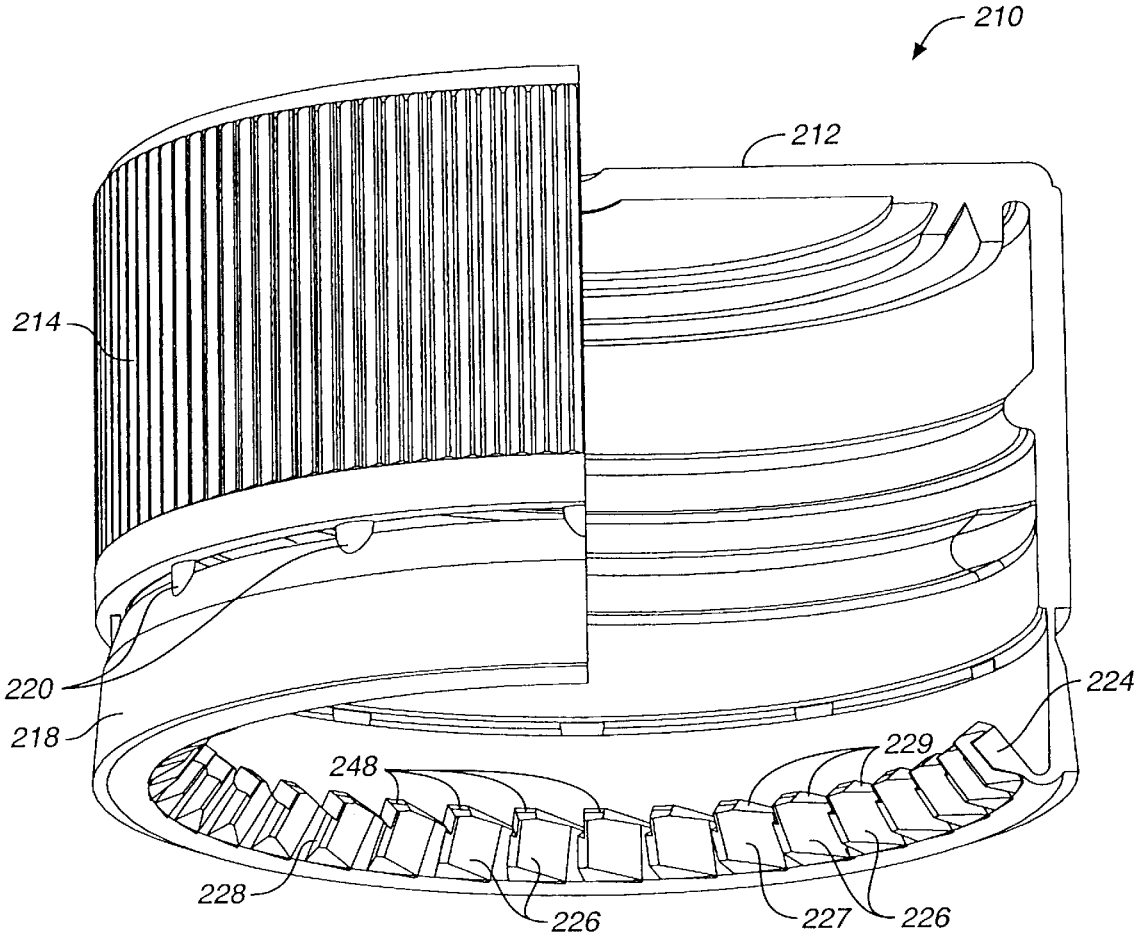
FIG. 13 is a perspective view from underneath of another embodiment of the improved tamper-evidencing closure of the present invention, shown with a quarter section cut away.
Figure 14:
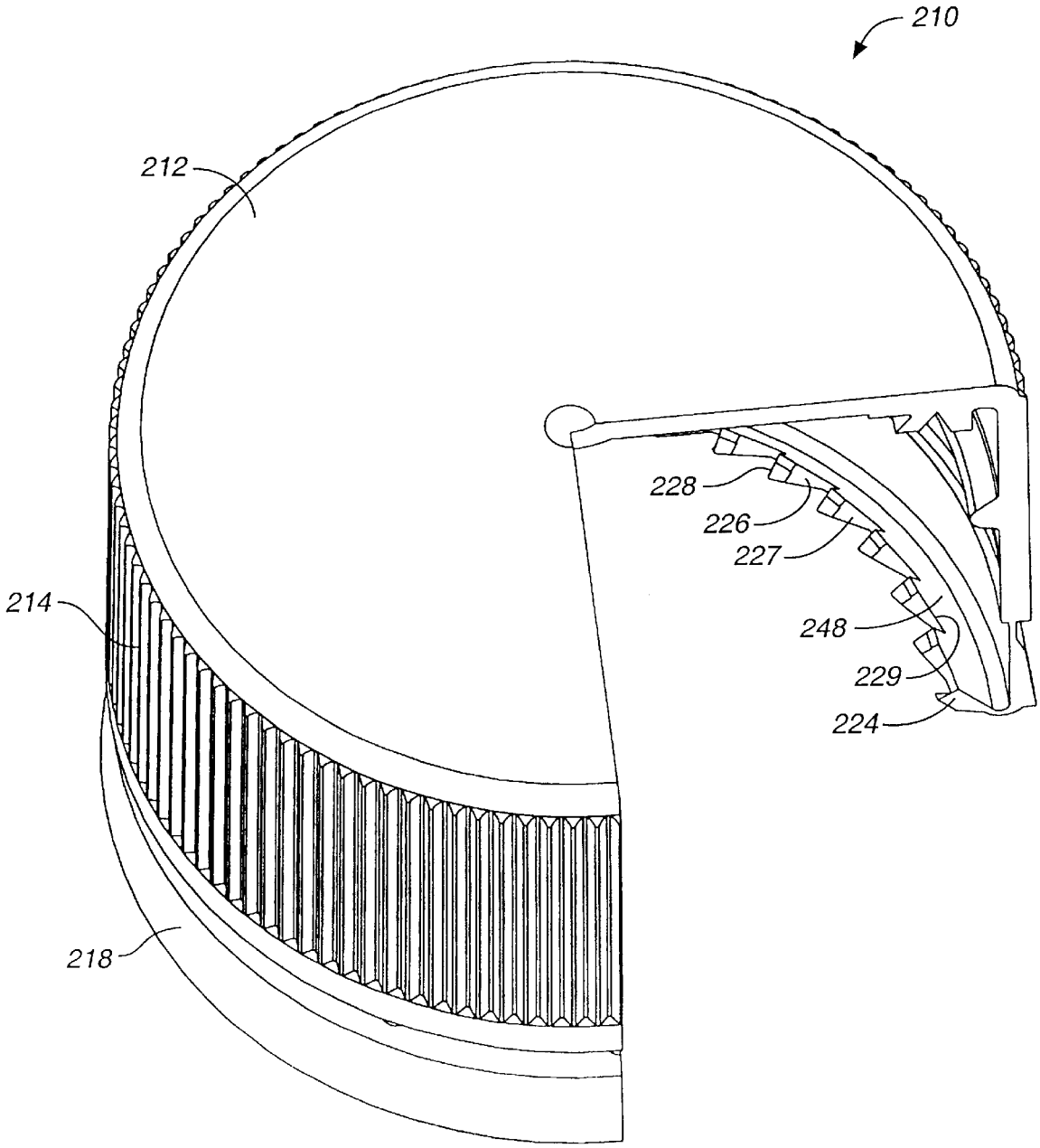
FIG. 14 is a perspective view from above of the tamper-evidencing closure of the present invention.

FIGS. 13 and 14 show another alternative embodiment for the tamper-evidencing band of the present invention. Cap 210 is similar to cap 10 of FIG. 1, except that tamper-evidencing band 218 has been modified. Cap 210 includes a top 212 and a skirt 214 and breakable connections 220 still connect skirt 214 to band 218. Tamper band 218 includes an inwardly and upwardly turned, annular retaining rim 224. In this embodiment, retaining rim 224 includes wedge or ramp elements 226 that form part of a ratchet mechanism for securing the tamper band. Ramp elements 226 each include a ramp surface 227 and a blunt radial side 228. Ramp elements 226 also include an upper ramp surface 229 that also forms part of a one-way ratchet mechanism for screwing on cap 210, as discussed herein.

Figure 15:
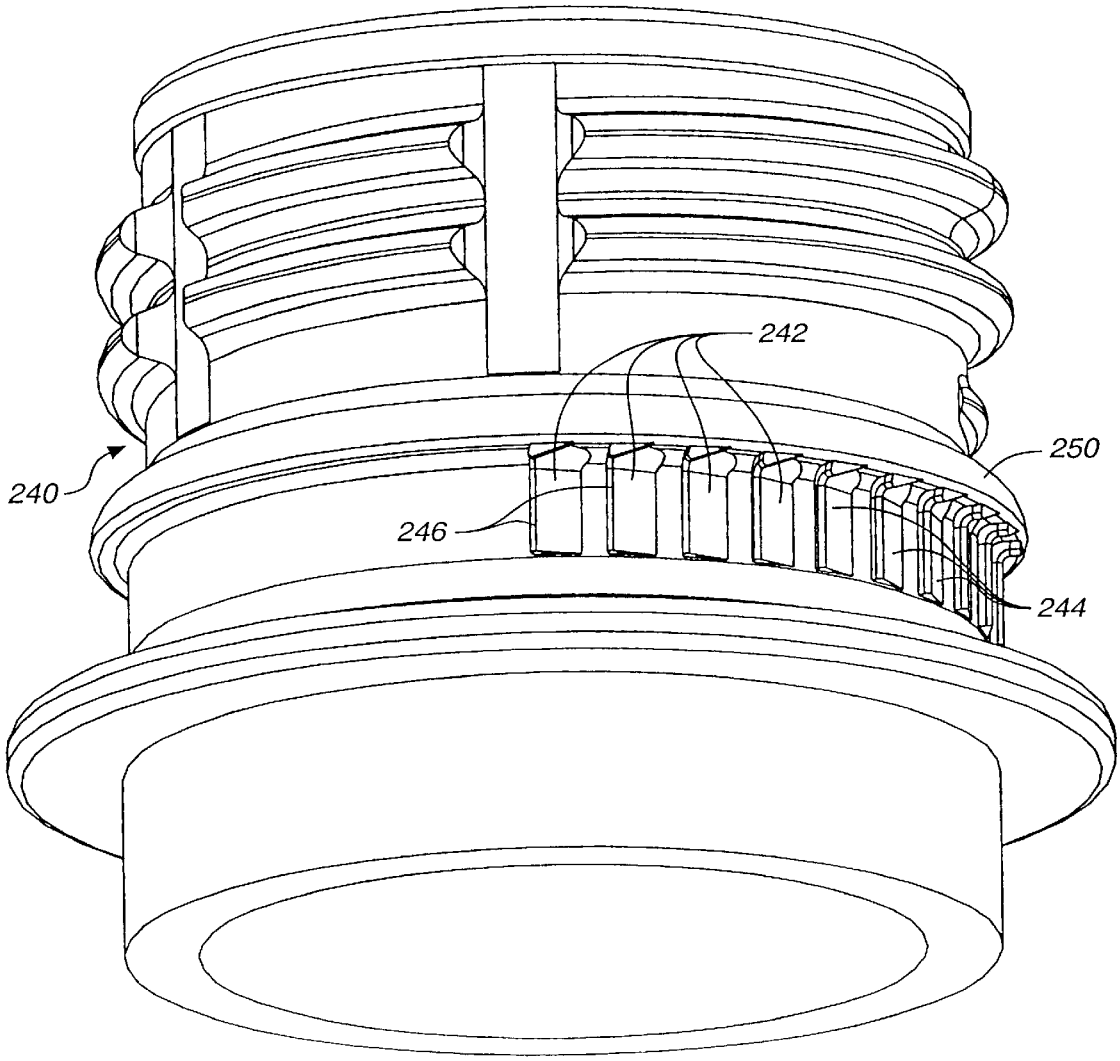
FIG. 15 is a perspective view of an improved container neck design for screwing the closure of FIG. 13 thereon.
Figure 16:
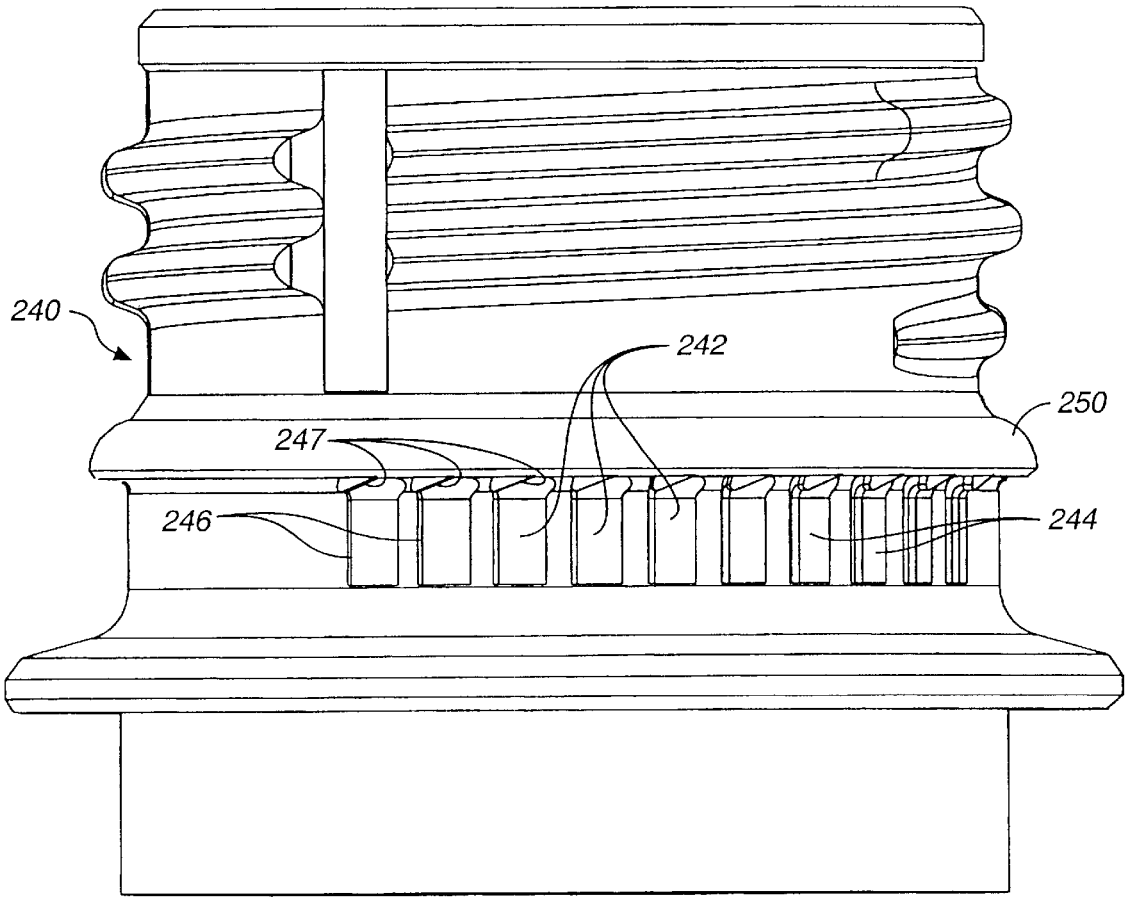
FIG. 16 is a side elevational view of the container neck of FIG. 15.

FIGS. 15 and 16 show neck 240 of a bottle that has similarly been modified to include a series of annularly spaced ramp elements 242, which also form part of the ratchet mechanism. Neck ramp elements 242 do not extend all the way around the neck, which is not believed to be necessary in order to restrain the cap, and in fact simplifies the manufacturing process for the neck. However, the ramp elements could extend annularly all around the neck if required. Each ramp element 242 includes an outwardly facing ramp surface 244, and a blunt side edge 246, similar to the ramp elements of the cap. Neck ramp elements 242 also include downwardly facing ramps 247 that extend radially outwardly, but not beyond the edge of a neck retaining rim or locking rim 250. Ramp surfaces 244, 247 and side edges 246 work in conjunction with ramp elements 226 of cap 210 to permit threading of cap 210 onto neck 240, as the respective ramp surfaces engage one another, and the blunt edges slide past one another.

Once threaded onto neck 240, upper edges 248 of ramp elements 226 engage neck locking rim 250 of neck 240, thereby preventing upward release of the cap. Also, once threaded on, blunt sides 228 of ramp elements 226 engage blunt sides 246 of ramp elements 242, which prevents unthreading of tamper-evidencing band 218. Ramp surfaces 244 and 227, and 229, 247 allow for easier mounting of the cap fully onto the neck.

In operation, cap 210 is threaded onto neck 240 until ramp elements 226 pop beneath neck locking rim 250. Then, to unscrew cap 210, skirt portion 214 is counter-rotated against the retention forces provided by the ratchet engagement of the ramp elements, which prevent unthreading of the tamper-evidencing band. Once the counter-rotational forces are great enough, breakable connections 220 fracture, thereby releasing cap 210 to continue unscrewing from the neck.

The ratchet design of retaining rim 218 and neck 240 provides a design for easy breaking of connections 220 and in addition provides sufficient surface area on the tops of ramp elements 226 to retain band 218 beneath locking rim 250. One should appreciate that inwardly directed pleats could be provided in combination with ramp elements in order to prevent outward flexing of retaining rim 224.

An advantage of the ratchet mechanism of the present invention is that it significantly improves the tamper evident feature of the bottle cap. With prior art tamper evident bands, it is possible to rotate the cap a certain amount before the breakable connections separated, which can break the seal lock of the cap without breaking off the connections. Thus, it is possible to rupture the seal lock without breaking the breakable connections, which creates the appearance of a proper seal when in fact the seal may have been broken. The present invention prevents any rotation of the tamper band. As such, the breakable connections will separate before the seal is broken, which is the desired result for providing evidence or an indication of tampering.

Figure 17:
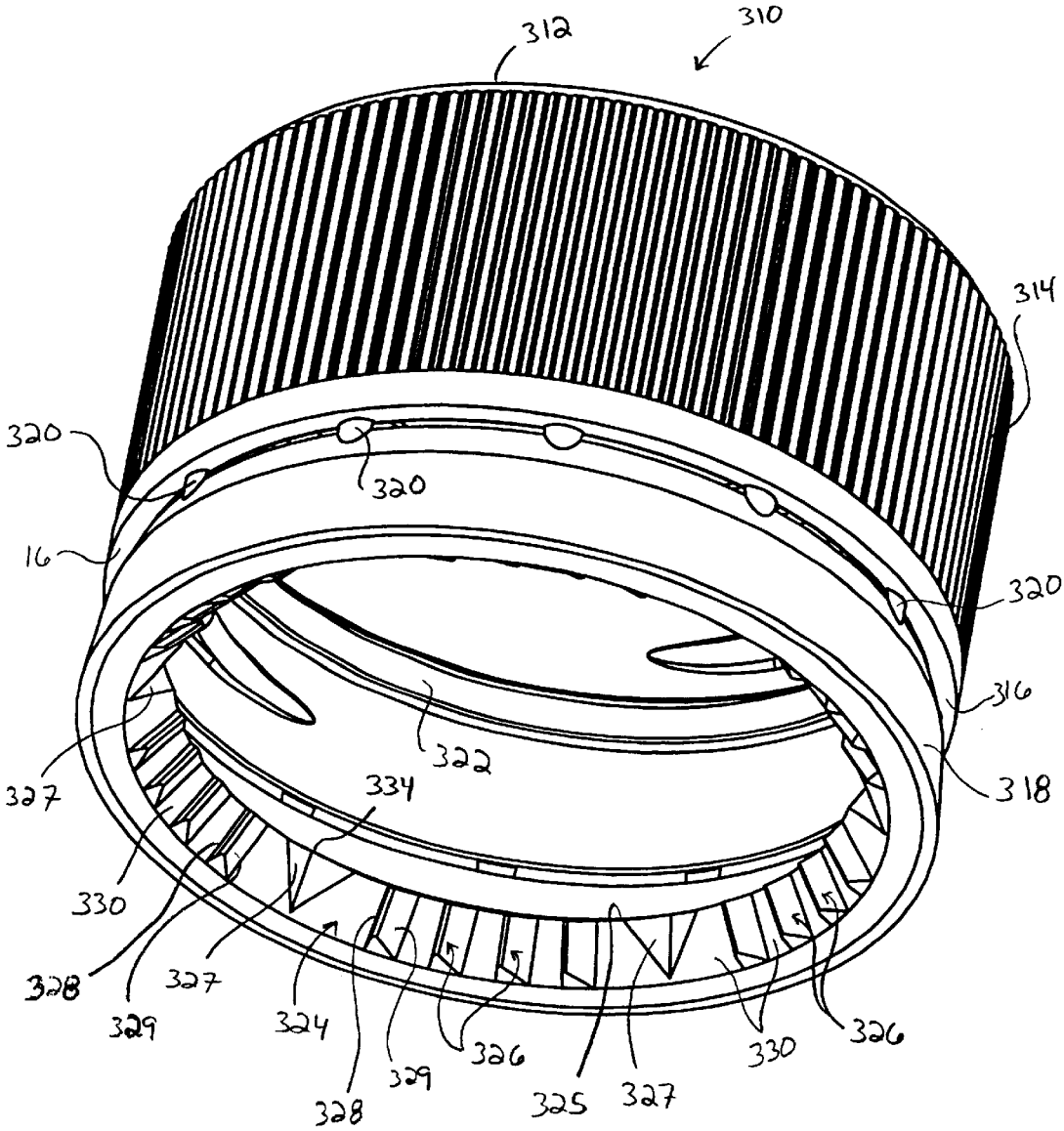
FIG. 17 is a perspective view, similar to FIG. 1, of another embodiment of the improved tamper-evidencing closure of the present invention.
Figures 18, 19:
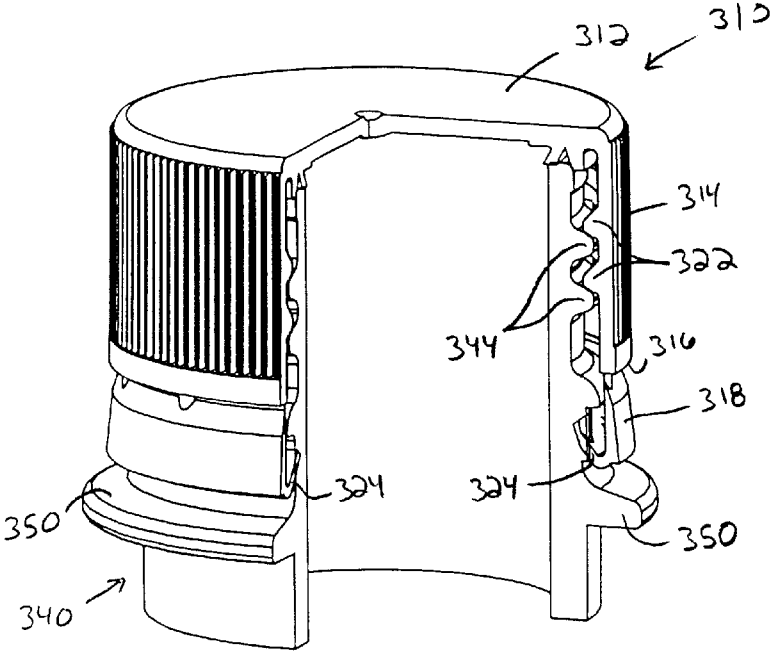
FIG. 18 is an exploded perspective view of the bottle cap of FIG. 17 and a container neck, with the tamper-evidencing closure shown in quarter section.
FIG. 19 is a quarter section perspective view of the tamper-evidencing closure of FIG. 18 mounted onto the container neck.

In the embodiment shown in FIGS. 17–19, a cap 310 is similar to cap 10 of FIG. 1 and to cap 310 of FIG. 13 but having a modified tamper-evidencing band 318. Cap 210 includes a top round portion 312 and a depending annular or cylindrical skirt 314. Breakable connections 320 connect a lower edge 316 of skirt 314 to a tamper-evidencing band 318 in the same manner discussed above. Tamper band 318 includes an inwardly and upwardly turned, annular retaining rim 324. In this embodiment, retaining rim 324 includes an upper free edge 326. Free edge 325 includes pleats 327 which are pleated outwardly. Free edge 325 also includes arcuate portions 330 between pleats 327. The pleats function in the same manner discussed above.

As shown in FIG. 17, retaining rim 324 also includes wedge or ramp elements 326 that form part of a ratchet mechanism for securing the tamper band. One should appreciate that one, two, three or more ramp elements can be utilized in accordance with the present invention. Cap ramp elements 326 each include a cap ramp surface 329 and a cap blunt radial side 328 which form part of a one-way ratchet mechanism for screwing on cap 310 and/or tamper-evidencing means for cap 310 as discussed herein. The ratchet mechanism functions in a same manner as discussed above.

FIGS. 18 and 19 shown a neck 340 of a bottle that has been similarly modified to includes a series of annularly spaced neck ramp elements 342 along a neck retaining rim or locking rim 350. Neck ramp elements 342 do not extend all the way around neck 340. One should appreciate, however, the ramp elements could extend annularly all around the neck in accordance with the present invention.

Each ramp element 342 includes an outwardly facing ramp surface 344, and a blunt side edge 346, similar to the ramp elements of cap 310. Ramp surfaces 344 and blunt side edges 346 work in conjunction with ramp elements 326 of cap 310 to permit threading of cap 310 onto neck 340, as the respective ramp surfaces engage one another, and the respective blunt edges slide past one another.

Once threaded onto neck 340, cap blunt side edges 328 of cap ramp elements 326 engage neck blunt side edges 346 of neck ramp elements 342 located on neck locking rim 350, thereby preventing undesired loosening of cap 310 with respect to neck 340 and the undesired upward release of the cap. In particular, blunt sides 328 of cap ramp elements 326 engage neck blunt sides 346 of ramp elements 342, thus preventing undesired unthreading of tamper-evidencing band 318. Ramp surfaces 344 and 329 allow for easier mounting of the cap fully onto the neck.

In operation, cap 310 is threaded onto neck 340 until ramp elements 326 pop beneath neck locking rim 350. Then, to unscrew cap 310, skirt portion 314 is counter-rotated against the retention forces provided by the ratchet engagement of the ramp elements, which prevent unthreading of the tamper-evidencing band. Once the counter-rotational forces are great enough, breakable connections 320 fracture, thereby releasing cap 310 to continue unscrewing from the neck.

The ratchet design of retaining rim 318 and neck 340 provides a design for easy breaking of connections 320 and, in addition, provides sufficient surface area on the tops of ramp elements 326 to retain band 318 beneath locking rim 350. Alternatively, inwardly directed pleats could be provided in combination with ramp elements in order to prevent outward flexing of retaining rim 324.

An advantage a tamper-evidencing band including both flutes and a ratchet mechanism, in accordance with the present invention, is that such a configuration significantly facilitates the application of a tamper evidencing closure on a neck or spout of a container. Closures that have tamper-evidencing bands provided with ratchets may be difficult to apply to a closure neck. In particular, tamper bands provided with ratchets are generally more rigid than tamper bands without ratchets and thus may break upon application of a closure to a neck. In particular, the ratchets may reduce elasticity of the band which may cause excess resistance when applying the closure to the neck which may intern damage the frangible connections. Similarly, because the bands with ratches are relatively rigid, such bands may hamper the application of the closure to a container neck because due to the difficulty encountered as the band passes over a retaining rim of the closure. A closure including a tamper-evidencing band having both flutes and a ratchet mechanism, in accordance with the present invention, overcomes such disadvantages because the flutes provide the band with additional "give" or flexibility and/or substantially restores the "give" or flexibility lost due to the presence of the ratchet mechanism. Such configuration thus facilitates application of the closure to a container neck, and in particular, facilitates the band in passing over the retaining rim of the container.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A tamper-evidencing closure comprising:

a top, a depending annular skirt and a tamper-evidencing band frangibly connected to said annular skirt;

said tamper-evidencing band including an inwardly turned retaining rim that extends at least partially upwardly, said retaining rim having a free edge adapted for engagement with a locking surface of a closure;

said retaining rim including a plurality of outwardly directed flutes spaced circumferentially thereon and a securing structure located on said retaining rim between said flutes.

2. The closure of claim 1 wherein said securing structure extends radially inwardly from said retaining rim.

3. The closure of claim 1, wherein said retaining rim extends inwardly as well as upwardly and is sufficiently vertically oriented.

4. The closure of claim 1 wherein said securing structure includes a ratchet mechanism adapted to engage a neck of a container for providing one-way screwing of said closure relative to the neck.

5. The closure of claim 1, wherein said securing structure comprises a locking mechanism adapted for preventing relative rotation between said closure and a neck of a closure in at least one direction.

6. The combination of claim 5, wherein said locking mechanism is a first ratchet.

7. In combination, a container and a tamper-evidencing closure comprising:

a neck defining an opening in said container, a first securing structure on said neck spaced from said opening;

said tamper-evidencing closure including a top, a depending annular skirt and a tamper-evidencing band frangibly connected to said annular skirt;

said tamper-evidencing band including an inwardly turned retaining rim that extends at least partially upwardly, said retaining rim having a free edge for engagement with said locking surface as said closure is removed from said neck;

said retaining rim including a plurality of outwardly directed flutes spaced circumferentially thereon and a second securing structure located on said retaining rim between said flutes.

8. The combination of claim 7 wherein said second securing structure extends from said retaining rim toward said first securing structure for engagement with said first securing structure upon rotation of said closure relative to said neck in at least one direction.

9. The combination of claim 7 wherein one of said first and second securing structures includes a ratchet mechanism that engages the other of said first and second securing structures that provides for one-way screwing of said closure relative to said neck.

10. The combination of claim 9, wherein the other of said first securing structure and said second securing structure comprises a second locking mechanism that cooperates with said first securing structure, said first locking mechanism is a first ratchet, and said second locking mechanism is a second ratchet cooperating with said first ratchet.

11. The combination of claim 7 wherein said neck comprises a locking surface on said neck intermediate said first securing structure and said opening, said locking surface having a portion which is substantially horizontal when said container is upright.

12. The combination of claim 11, wherein said retaining rim extends inwardly as well as upwardly and is sufficiently vertically oriented so that said locking surface prevents movement of said retaining rim upon engagement of said free edge with said locking surface.

13. The combination of claim 11, wherein the distance between said locking surface and said opening is approximately equal to the distance between said free edge and said top, so that upon full mounting of said closure on said neck, said retaining rim is positioned beneath said locking surface with said free edge proximal said locking surface.

14. The combination of claim 7, wherein one of said first securing structure and said second securing structure comprises a first locking mechanism which prevents relative rotation between said closure and said neck in at least one direction.

15. The combination of claim 14, wherein said first locking mechanism is a first ratchet.

16. The combination of claim 14, wherein the other of said first securing structure and said second securing structure comprises a second locking mechanism that cooperates with said first securing structure and said second locking mechanism is a second ratchet.

* * * * *